US005501156A

United States Patent [19]

Richter

[11] Patent Number: 5,501,156

[45] Date of Patent: Mar. 26, 1996

[54] CURVED GUIDE RAIL

[76] Inventor: Hans Richter, Ortlerstrasse 77, Augsburg, Germany, D-86163

[21] Appl. No.: 232,195

[22] PCT Filed: Aug. 21, 1993

[86] PCT No.: PCT/EP93/02253

§ 371 Date: May 4, 1994

§ 102(e) Date: May 4, 1994

[87] PCT Pub. No.: WO94/05860

PCT Pub. Date: Mar. 17, 1994

[30] Foreign Application Priority Data

Sep. 5, 1992 [DE] Germany ..... 42 29 725.7

[51] Int. Cl.[6] ..... E01B 25/24; E01B 25/22

[52] U.S. Cl. ..... 104/89; 104/106; 104/112; 198/861.2; 238/10 R

[58] Field of Search ..... 104/89, 93, 95, 104/106, 112, 118, 119, 123, 124, 126; 238/10 R; 105/141, 150; 267/162, 182; 411/383, 392, 544, 545, 546; 198/861.2

[56] References Cited

U.S. PATENT DOCUMENTS 2,534,123 12/1950 Hasselhorn ..... 267/162

FOREIGN PATENT DOCUMENTS 1182397 6/1959 France .
4014069 3/1992 Germany .
3-050061 3/1991 Japan .
364994 11/1962 Switzerland .

*Primary Examiner*—Robert J. Oberleitner
*Assistant Examiner*—Kevin D. Rutherford

[57] ABSTRACT

A curved guide rail for passenger and material transportation systems in which sheet-metal plates (3), wedged against one another, are arranged in a row on a prestressed rope (2) and the spaces in-between are bridged by an overlapping tooth construction (5), so that the guide rail can be curved as desired prior to being braced.

20 Claims, 2 Drawing Sheets

CURVED GUIDE RAIL

FIELD OF THE INVENTION

The present invention relates to a guide rail for passenger and material transportation systems and a method for assembling same.

BACKGROUND TO THE INVENTION

Guide rails of the aforementioned type, are disclosed, for example, in DE-OS 40 14 069, consist of flexible plastic pipes which, after having been bent along a turn, are stabilized by being filled with a casting compound.

The disadvantage of this is that the guide rail cannot be used again in the old form after having been used once.

SUMMARY OF THE INVENTION

It is an object of the invention to design the guide rails in such a way that they can be used again.

In accordance with an embodiment of the invention, a multi-dimensionally bendable guide rail for passenger and material transportation systems is comprised of sheet-metal plates stacked on a guy rope, the sheet-metal plates having a central bore for the guy rope, a slightly conically outward extending cylindrical part being centered on the central bore, a radially outwardly curved transition piece in the form of an arch adjoining the cylindrical part, the sheet-metal plates being stacked on the guy rope so that the cylindrical part of one sheet-metal plate partially protrudes into the cylindrical part of an adjacent plate, the guide rail being bendable in its flexible state when the sheet-metal plates are slightly pressed together and being fixed in its curved form when the sheet-metal plates are strongly pressed together.

BRIEF INTRODUCTION TO THE DRAWINGS

An embodiment of a guide rail in accordance with the invention is illustrated in the following drawings, in which.

DETAILED DESCRIPTION OF THE INVENTION

Figure 1:
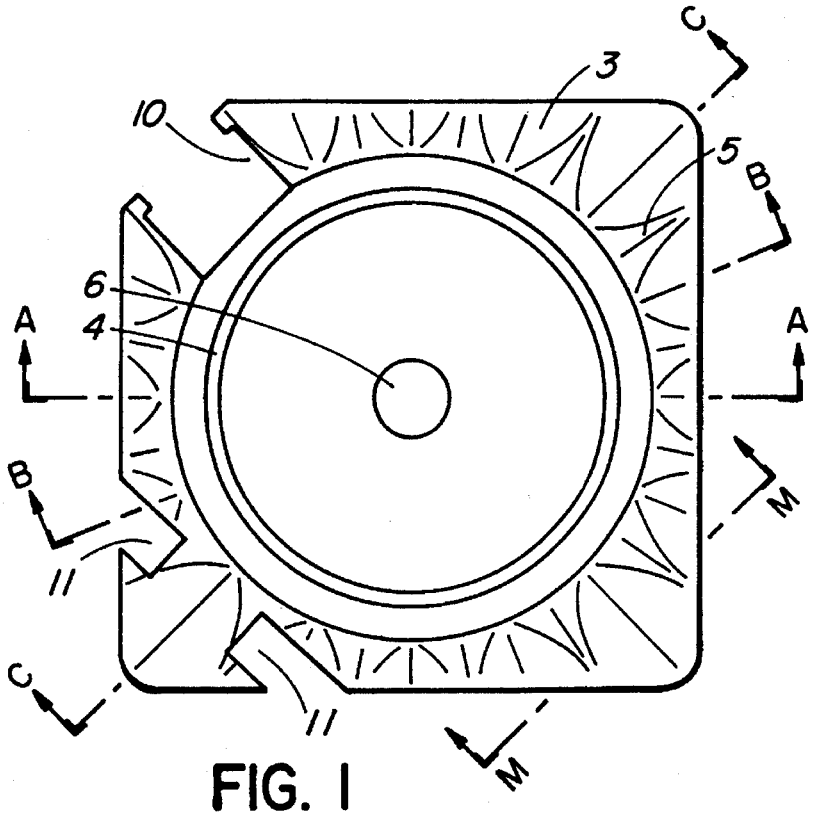
FIG. 1 is a top view onto a sheet-metal plate of a flexible guide rail.
Figure 3:
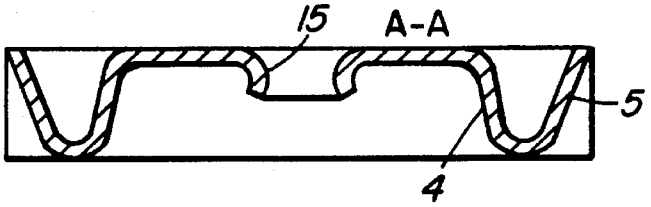
FIG. 3 is a section along the line A—A in FIG. 1.
Figure 4:
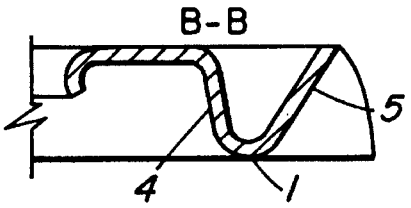
FIG. 4 is a section along the line B—B in FIG. 1.
Figure 5:
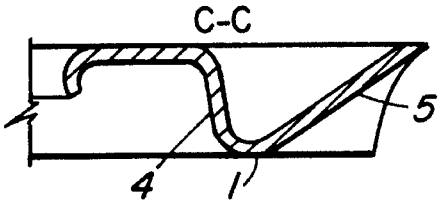
FIG. 5 is a section along the line C—C in FIG. 1.
Figure 6:
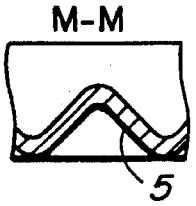
FIG. 6 is a section along the line M—M.

A sheet-metal plate 3 is constructed, for example, as a square stamped plate part. In its centre, it has a slightly conical annular cylinder part 4 with a cable bore 6 in the middle. The cable bore 6 has a protrusion 15 to protect the guy rope 2. The plate 3 is made flat in the shape of an annular disk between the protrusion 15 and the cylinder part 4. The transition between the flat part and the cylinder part 4 is rounded.

Figure 2:
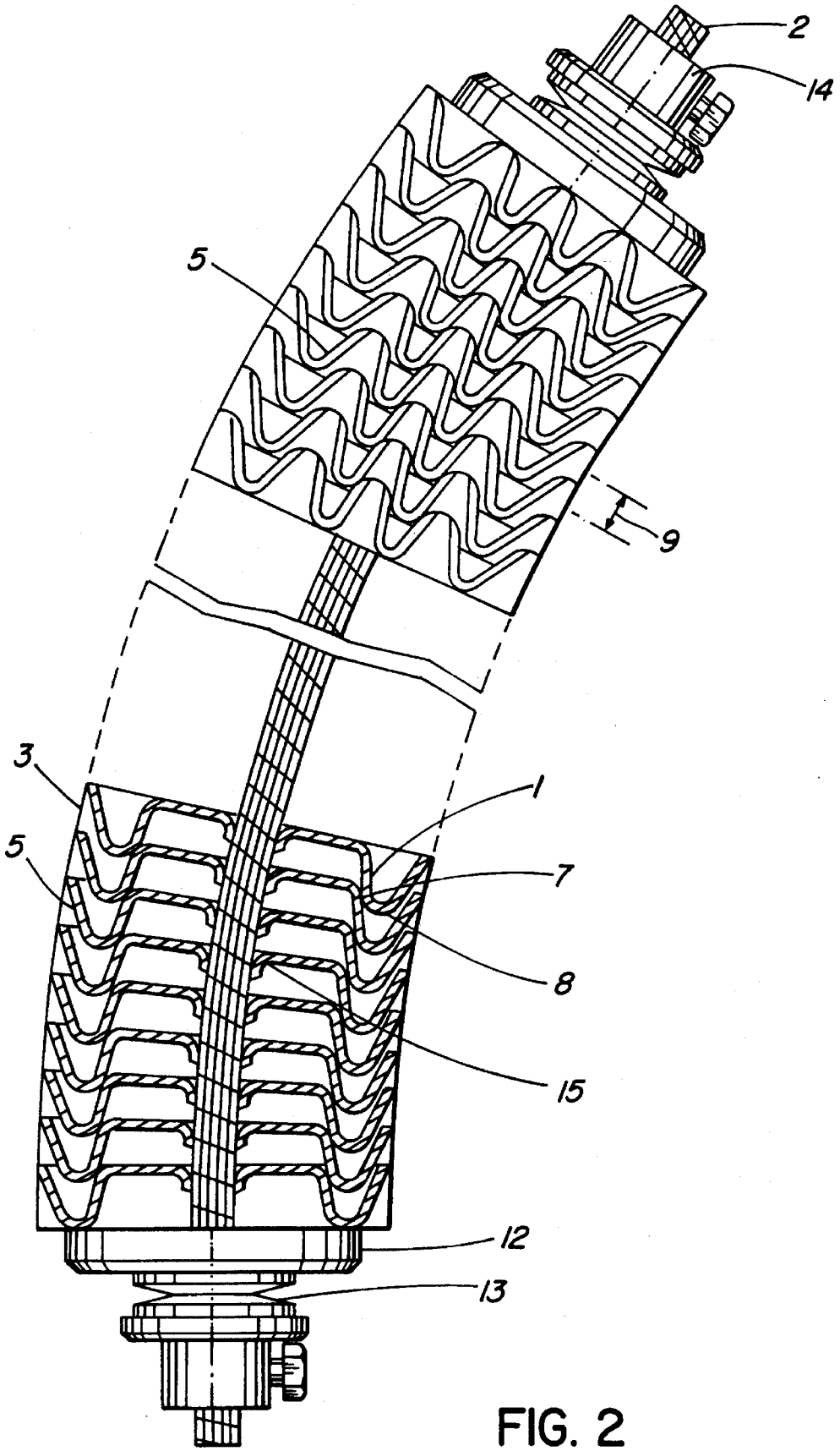
FIG. 2 is a view of a piece of the flexible guide rail, as a section in the lower part, as an elevation in the upper part.

The conical cylinder part 4 is designed in such a way that it is stayed on all sides at the point of contact 7 with its adjacent sheet-metal plate 8. The sheet-metal plates 3 are constructed in such a way that, set on top of one another in a stack, they permit both curves and torsions of the guide rails. The cylinder part 4 of one plate 3 partially protrudes into the cylinder part 4 of the adjacent plate 8. A curve-shaped transition piece 1 adjoins the conical cylinder part 4. As can be seen in FIG. 2, the point of contact 7 is formed on the right by the line of contact between the cylinder parts 4 of the sheet-metal plates 3, 8, while on the left it is formed by the line of contact between the start of the transition piece 1 of plate 3 and the inside start of the cylinder part 4 of plate 8.

The periphery of the sheet-metal plate 3 is formed into corrugated teeth on the outside adjacent to the transition piece 1, whereby the corrugated teeth 5 also overlap in the curved state in longitudinal direction of the guide rail, as shown at 9. The corrugated teeth 5 are radially aligned.

The periphery of the sheet-metal plate 3 has an opening for conveying means 10 for inserting conveying means such as chains and tangentially extending grooves 11 for fastening the guide rails.

Pressure plates 12, plate spring stacks 13 and a clamping device 14 which brace a guy rope 2 and maintain the stack at a constant initial stress are located at the start and end of the guide rails.

If a curved guide track is to be constructed, then the preassembled, slightly prestressed guide track is laid as desired and attached by means of mounting supports, not shown, at grooves 11. The tensile stress of the guy rope 2 is then increased, so that the slightly conical cylinder parts 4 are braced in one another so strongly by the wedging effect that they cannot be turned or twisted even when loaded with an equalizing truck etc. To increase this friction, the points of contact 7 can be grooved or provided with a friction lining. When a guide rail is curved, the cylinder parts 4 of adjacent plates 3, 8 engage more deeply into one another in the curve interior than in the curve exterior.

A rolling or sliding equalizing truck can now travel along the guide rails almost free of jolts due to the teeth 5 bridging the spaces of the individual sheet-metal plates.

I claim:

1. A multi-dimensionally bendable guide rail for passenger and material transportation system in which sheet-metal plates are stacked on a guy rope, said sheet-metal plates having a central bore for said guy rope, a slightly conically outward extending cylindrical part being centered on said central bore, a radially outward curved transition piece in the form of an arch adjoining said cylindrical part, said sheet-metal plates being stacked on said guy rope so that the cylindrical part of one sheet-metal plate partially protrudes into the cylindrical part of the adjacent plate, the guide rail being bendable in its flexible state when said sheet-metal plates are slightly pressed together and being fixed in its curved form when said sheet-metal plates are strongly pressed together.

2. A guide rail as defined in claim 1, wherein the sheet-metal plates are flat between the cable bore and the cylinder portion.

3. A guide rail as defined in claim 2, wherein the transition from the flat part to the cylinder part is rounded.

4. A guide rail as defined in claim 3, the periphery of the sheet-metal plates having radially oriented corrugated teeth adjacent to the transition piece.

5. A guide rail as defined in claim 4, a pressure plate being located on each end of the guide rail.

6. A guide rail as defined in claim 5, plate springs and a clamping device being located on at least one end.

7. A guide rail as defined in claim 4, two grooves being provided opposite one another on the periphery of sheet-metal plates for holding a guide rail.

8. A guide rail as defined in claim 3, wherein the sheet-metal plates are flat between the cable bore and the cylinder portion.

9. A guide rail as defined in claim 2, the periphery of the sheet-metal plates having radially oriented corrugated teeth adjacent to the transition piece.

10. A guide rail as defined in claim 1, a pressure plate being located on each end of the guide rail.

11. A guide rail as defined in claim 10, plate springs and a clamping device being located on at least one end.

12. An assembly method for a guide rail of a form as defined in claim 11, comprising the steps of slightly prestressing the sheet-metal plates in a row on the guy rope, staggering the sheet-metal plates at an angle to form a curve of the guide rail, and then increasing the pressure on the sheet-metal plates.

13. A guide rail as defined in claim 1, wherein the surfaces of the cylinder portion and transition piece are rough.

14. A guide rail as defined in claim 13, the periphery of the sheet-metal plates having radially oriented corrugated teeth adjacent to the transition piece.

15. A guide rail as defined in claim 1, at least one groove being provided on the periphery of each of the sheet-metal plates for holding conveying means.

16. A guide rail as defined in claim 15, at least one additional groove being provided on the periphery of each of the sheet-metal plates for holding a guide rail.

17. A guide rail as defined in claim 1, the cable bore having a protrusion.

18. A guide rail as defined in claim 1, the periphery of the sheet-metal plates having radially oriented corrugated teeth adjacent to the transition piece.

19. A guide rail as defined in claim 1, wherein the sheet-metal plates are essentially rectangular.

20. An assembly method for a guide rail of a form as defined claim 1, comprising the steps of slightly prestressing the sheet-metal plates in a row on the guy rope, staggering the sheet-metal plates at an angle to form a curve of the guide rail, and then increasing the pressure on the sheet-metal plates.

* * * * *